United States Patent [19]

Tanaka et al.

[11] 4,218,246

[45] Aug. 19, 1980

[54] METHOD OF ELECTROPHOTOGRAPHIC RECORDING INVOLVING REMOVAL OF EXCESS DEVELOPER LIQUID BY CORONA TREATMENT

[75] Inventors: Hiroshi Tanaka; Takashi Saito, both of Tokyo, Japan

[73] Assignee: Canon Kabushiki Kaisha, Tokyio, Japan

[21] Appl. No.: 870,714

[22] Filed: Jan. 19, 1978

Related U.S. Application Data

[63] Continuation of Ser. No. 650,044, Jan. 19, 1976, abandoned, which is a continuation of Ser. No. 366,262, Jun. 4, 1973, abandoned, which is a continuation of Ser. No. 122,861, Mar. 10, 1971, abandoned.

[30] Foreign Application Priority Data

Mar. 18, 1970 [JP] Japan ..... 45-22822

[51] Int. Cl.[2] ..... G03G 13/10

[52] U.S. Cl. ..... 430/126; 134/1; 355/3 TR; 355/10; 430/113; 430/117; 430/937

[58] Field of Search ..... 96/1.4, 1 LY; 118/637, 118/639; 355/10, 3 TR; 134/1; 427/16

[56] References Cited

U.S. PATENT DOCUMENTS

| | | | |
|---|---|---|---|
| 3,084,061 | 4/1963 | Hall | 117/17.5 |
| 3,155,546 | 11/1964 | Dirks | 118/637 |
| 3,355,288 | 11/1967 | Matkan | 96/1 |
| 3,559,620 | 2/1971 | Seib | 118/637 |
| 3,663,219 | 5/1972 | Takahashi | 96/1.4 |

*Primary Examiner*—John D. Welsh

*Attorney, Agent, or Firm*—Fitzpatrick, Cella, harper & Scinto

[57] ABSTRACT

A method of transferring images produced by liquid developer in a photographic process which comprises applying a corona charging to a photosensitive member after the development of latent images to increase the attaching force of a toner of the developed image to the photosensitive member and remove the liquid developer and transferring the developed image to a copying web. The corona charging may be applied to the photosensitive member at a point, after development, wherein the angle subtended by a vertical line passing through the center of a drum photosensitive member and a line connecting the center of the drum photosensitive member with the point on the surface of the drum photosensitive member to which the corona charging is applied is not larger than 60°.

4 Claims, 2 Drawing Figures

METHOD OF ELECTROPHOTOGRAPHIC RECORDING INVOLVING REMOVAL OF EXCESS DEVELOPER LIQUID BY CORONA TREATMENT

This is a continuation of application Ser. No. 650,044, filed Jan. 19, 1976, now abandoned, which in turn is a continuation of application Ser. No. 366,262, filed June 4, 1973, now abandoned, which in turn is a continuation of application Ser. No. 122,861, filed Mar. 10, 1971, now abandoned.

BACKGROUND OF THE INVENTION

1. Field of the Invention

This invention relates to a method for transferring images produced by liquid developer in electrophotographic processes.

2. Description of the Prior Art

Heretofore, a liquid development of latent images in electrophotography is usually carried out on a selenium photosensitive member in Xerography or a photosensitive member (e.g. U.S. Ser. No. 563,899, filed July 8, 1966 and U.S. Ser. No. 571,538, filed Aug. 10, 1966, and now U.S. Pat. No. 3,666,363) having an insulating layer on a photoconductive layer and the surface being smooth. The image thus developed often flows due to the smooth surface of the photosensitive member, and the presence of carrier liquid. In other words, the toner in the developed image flows since the Coulomb's force of the charge of the latent image for retaining the toner is overcome by the flowing action of the carrier liquid caused by movement of the photosensitive member, for example, rotation of a drum photosensitive member. As a result, disorder of toner images occurs, that is, even a slight external force disturbs the developed toner image.

For the purpose of improving the transferring efficiency and obtaining high speed development, it is preferable to use a liquid developer having relatively low electric resistance such as $1\times10^{10}-5\times10^{12}\Omega\cdot$cm. However, in such a case the neutralization of charge of the latent image rapidly proceeds and therefore, Coulomb's force is decreased rapidly and thereby the image flow becomes remarkable.

SUMMARY OF THE INVENTION

This invention relates to a method for transferring images produced by liquid developer in a photographic process which comprises applying a corona charging to a photosensitive member after the development of latent iamges to increase the attaching force of the toner of the developed image to the photosensitive member and remove the liquid developer and transferring the developed image to a copying web. And it is preferable to apply the corona charging to the photosensitive member, after development, at such a point that an angle subtended by a vertical line passing the center of a drum photosensitive member and a line connecting the center of the drum photosensitive member with the point on the surface of the drum photosensitive member to which the corona charging is applied is not larger than 60°.

Further, it is also preferable to use a liquid developer having an electric resistance of $1\times10^{10}-5\times10^{12}\Omega\cdot$cm.

An object of this invention is to provide a method for transferring images produced by a liquid developer without any disorder.

Another object of this invention is to provide a method for giving an image produced by a toner adhered tightly to a copying paper.

A further object of this invention is to provide an image of good guality by using a liquid developer of low electric resistance.

Still another object of this invention is to provide a method for transferring images produced by a liquid developer at high speed and with high transferring efficiency.

A still further object of this invention is to provide a method for producing clear transferred iamges.

DESCRIPTION OF THE PREFERRED EMBODIMENT

The present invention will be described in connection with the electrophotographic processes as disclosed in the above identified U.S. Patents.

Figure 1:
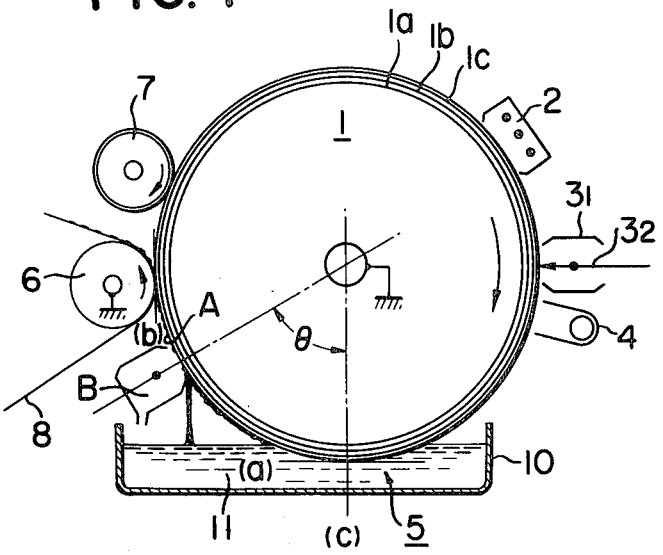
FIG. 1 schematically shows a cross sectional view of an apparatus carrying out an embodiment of this invention.

Referring to FIG. 1, a photosensitive member 1 comprises a base 1*a*, a photoconductive layer 1*b* and an insulating layer 1*c* and is uniformly charged by a primary charging device 2, then charged with DC voltage having a polarity opposite to the primary charging or AC corona discharge by using a charging device $3_1$ simultaneously with exposing to a light image as represented by $3_2$, and further the whole surface of photosensitive member 1 is exposed to a light denoted as 4 to form an electrostatic latent image. The latent image thus produced is developed by a developing device 5 (5' in FIG. 2) and transferred to a copying paper 8 by a transferring roller 6 and, then photosensitive member 1 is cleaned by a cleaning roller 7.

Figure 2:
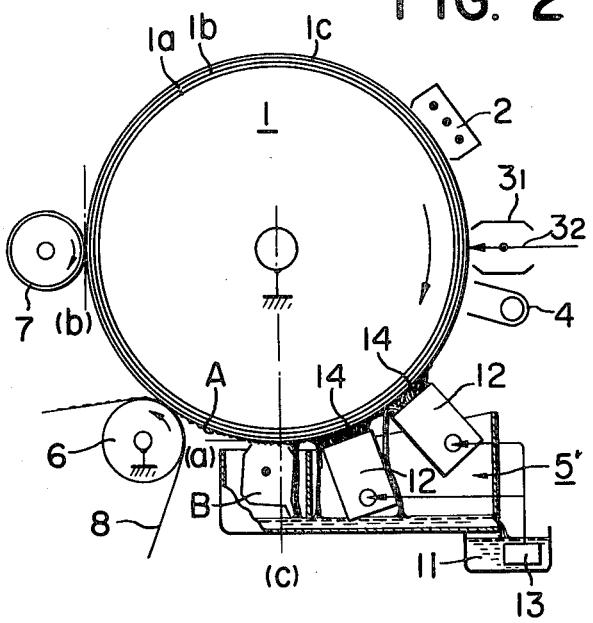
FIG. 2 schematically shows a cross sectional view of an apparatus carrying out another embodiment of this invention.

FIG. 1 and FIG. 2 are different from each other only in the developing device. In FIG. 1 the development is carried out by a soaking developing method comprising soaking the lower portion of drum 1 in a liquid developer 11 placed in a developing vessel, while in FIG. 2 the developing is conducted by a contacting developing method comprising slowly flowing out a liquid developer from a flowing mouth at the top of a liquid developer feeding box 12 and contacting the liquid developer with the drum surface. The liquid developer 11 is charged to the liquid developer feeding box 12 by a pump 13. According to another embodiment of the contacting method, a roller is placed in a liquid developer in such a way that the lower half of the roller is soaked in the liquid developer or two rollers are arranged in such a way that each of these rollers rotates to an inside direction, and thereby the liquid developer rises to contact the surface of with a lower or a lower slanting surface of the drum photosensitive member 1 to develop the latent image.

Another example of liquid developing means for such a drum photosensitive member is a cascade developing method comprising pouring a liquid developer onto a rotating drum photosensitive member from the upper portion or from the side portion and flowing down the liquid developer along the surface of the drum photosensitive member.

In all of the above-mentioned liquid developing methods for a drum photosensitive member the surface of a drum photosensitive member 1 being developed goes up according to the rotation of the drum photosensitive member. For example, in FIG. 1 and FIG. 2, a tangent line at an image A changes from the horizontal direction (a) via a slanting direction to the vertical direction (b) and during such step of changing the tangent line from the horizontal to the vertical direction, an image flow at the surface of the drum photosensitive is liable to occur. The image flow is caused by a flow on the surface of the drum photosensitive member to a direction opposite to the rotation of the drum which removes the toner attached to the latent image from the surface of the drum and further the smoothness of the photosensitive member accelerates such tendency.

When the corona charging device B is fitted to a position within an angle of 60°, as mentioned above, there is no adverse effect due to image flow.

In FIG. 1, the charging device B is located at the position of about 60° while in FIG. 2 the charging device B is located at the position almost beneath the center of the drum.

According to such arrangement of the charging device, the developed image can be tightly attached to the surface of the photosensitive member before the carrier liquid attached to the surface of the drum photosensitive member immediately after the development begins to flow or during a period when the flowing of the carrier liquid is still slow and does not adversely affect the developed image. Furthermore, the majority of the carrier liquid can be removed from the drum photosensitive member and an image surface having little carrier liquid attached thereto is produced. Therefore, when the image is transferred to a copying paper, a transferred image free from disorder can be obtained. If the charging device B is located at a portion larger than 60°, the carrier liquid naturally flowing down along the surface of the drum photosensitive member combined with a carrier liquid squeezed out by the charging causes an image flow to a great extent.

It is preferable to arrange the charging device B as illustrated in FIG. 2, at a portion near to a point beneath the center of the drum as far as possible, but an opening may be provided to the charging device B as shown in FIG. 1 and FIG. 2 so as to remove the liquid developer coming thereinto.

According to this invention, there is used a liquid developer of relatively low electric resistance such as $1\times10^{10}-5\times10^{12}\Omega\cdot$cm. The liquid developer of low resistance improves the mobility of toner and is suitable for a high speed development and further the transferring efficiency is increased as a result of a reduction in the adhering force of the toner, in the developed image to the latent image on the photosensitive member since the charge of the toner image is rapidly neutralized with the charge of the latent image after the development. However, the rapid neutralization disadvantageously causes the image flow as mentioned above before the transferring of the developed image.

It is most preferable that the developed image is electrically attached tightly to the surface of the photosensitive member and the electrical adhering force is disappeared at a time of transferring because such a condition enables to increase developing speed and produce an image free from disorder at a high efficiency.

According to the present invention the above-mentioned purpose can be attained by using a liquid developer of low electric resistance in combination with the charging device placed at a specified point. That is, a corona charging is directly applied to a surface of the photosensitive member developed by the liquid developer of low resistance at high speed and the image thus developed is tightly attached to the photosensitive member by a charge of polarity similar to that of the toner at the image portion and the carrier liquid is removed.

At the time of transferring, the charge of the latent image relating to the image toner is neutralized with an ion component in the carrier and/or charging of development to reduce the electric force and thereby the developed image can be transferred to a copying paper at high efficiency without causing disorder.

In FIG. 2, there is used a liquid developer having a volume resistivity of $1\times10^{10}-5\times10^{12}\Omega\cdot$cm. comprising a coloring matter mainly composed of carbon black and a resin dispersed in Isopar G (tradename, supplied by ESSO) to which is added asphalt, motor oil and a fatty acid. As a result, the developing velocity is increased to give a good image at high transferring efficiency.

Particularly, this invention is very effective for a liquid developing of an electrostatic latent image on a photosensitive member having a highly insulating film. When a film material of extremely low $RC=\tau$ (time constant) such as Mylar (tradename, supplied by E. I. du Pont de Nemours & Co., Inc.) is used, the charge is apt to disappear when it contacts the surface of the liquid developer. In this invention, it is preferable to place the charging device at a position at which the developed image arrives within about 5 seconds.

We claim:

1. An electrophotographic recording method utilizing a rotatable drum, formed with a photoconductive layer, on which drum a latent electrophotographic image may be formed, developed with toner and thereafter transferred to a transfer material, comprising the steps of forming a latent electrophotographic image on said drum; then applying liquid developer onto said drum to form a toner image of said latent electrophotographic image, said liquid developer comprising a carrier liquid having toner dispersed therein; thereafter removing, without mechanical intervention, excess liquid from said drum to prevent the flow of the toner image by subjecting said drum to corona discharge of the same polarity as that of the toner, wherein said corona discharge simultaneously acts to increase the attaching force of said toner image to said drum, wherein the longitudinal axis of said drum extends in a horizontal direction and wherein said corona is applied to said drum at a position disposed within an angle less than 60 degrees from a vertical line extending downwardly from the longitudinal axis of said drum and measured in the direction of drum rotation; and thereafter transferring the toner image to transfer material.

2. A method according to claim 1, wherein said liquid developer has an electric resistance of from $1\times10^{10}-5\times10^{12}\Omega\cdot$cm for high speed development.

3. A method according to claim 1, wherein said rotatable drum further includes an outer insulating film layer.

4. An electrophotographic recording method utilizing an endless rotatable medium, formed with a photoconductive layer, on which a latent electrophotographic image may be formed, developed with toner and thereafter transferred to a transfer material, comprising the steps of forming a latent electrophotographic image on said medium; then applying liquid developer onto said medium to form a toner image, said liquid developer comprising a carrier liquid having toner dispersed therein; thereafter removing excess liquid developer from said medium without mechanical intervention by subjecting said medium to corona discharge of the same polarity as that of the toner, wherein said corona discharge simultaneously acts to increase the attaching force of said toner image to said medium; and thereafter transferring the toner image to transfer material.

* * * * *